US006537642B1

(12) United States Patent
Jacquet

(10) Patent No.: US 6,537,642 B1
(45) Date of Patent: Mar. 25, 2003

(54) PERFORATED FLOOR MAT HOLDER

(76) Inventor: Gregoire Jacquet, 1231 21st. Ave., #2, San Francisco, CA (US) 94122

( * ) Notice: Subject to any disclaimer, the term of this patent is extended or adjusted under 35 U.S.C. 154(b) by 0 days.

(21) Appl. No.: 09/435,511

(22) Filed: Nov. 8, 1999

(51) Int. Cl.[7] ..... B32B 3/06; B32B 7/00; B05C 17/10; A47L 1/06; A47L 23/22; A47K 2/02; E04F 11/16; E04F 15/00

(52) U.S. Cl. ..... 428/99; 428/100; 428/119; 428/120; 52/177; 52/180; 15/215; 15/238; 15/241

(58) Field of Search ..... 428/99, 100, 119, 428/120; 52/177, 180; 15/215, 238, 241

(56) References Cited

U.S. PATENT DOCUMENTS 6,050,621 A * 4/2000 Martinez, Jr. et al. ..... 292/289
6,068,908 A * 5/2000 Kessler et al. ..... 428/100

OTHER PUBLICATIONS

Atlantic Rubber Products, Inc., Products web page Sep. 6, 1999.
Cactus Mat MFG. Co., Catalog p. 55, 2000.
Tapis Dexterieur, Catalog p. 893, date unknown.

* cited by examiner

*Primary Examiner*—Harold Pyon
*Assistant Examiner*—Patricia L. Nordmeyer
(74) *Attorney, Agent, or Firm*—Donald L. Beeson

(57) ABSTRACT

The present perforated floor mat holder is for securing perforated rubber floor mats on a wet and slippery floor. It is comprised of an elongated strip with studs arranged at regular intervals that match the spacing of the holes on the floor mat. The strip is fastened to a floor with screws inserted through mounting holes arranged along the strip. The floor mat is positioned on the strip with the hole around the studs. The stress applied to the rims of the holes by the studs are spread among a relatively large number of holes, so that the rims resist being torn by the studs. Transverse grooves arranged several studs apart on the strip enable the strip to be broken into shorter sections of a predetermined minimum length. In a first embodiment, one mounting hole is arranged between each pair of adjacent studs.

18 Claims, 1 Drawing Sheet

PERFORATED FLOOR MAT HOLDER

BACKGROUND OF THE INVENTION

1. Field of the Invention

This invention relates generally to floor mats.

2. Prior Art

A perforated rubber floor mat is typically used to provide improved traction on a wet floor, such as in a restaurant kitchen. It is also used to provide a cushioned walking surface for reducing fatigue. It includes a large array of holes for draining liquid and wet materials away from its top surface. However, liquid tends to be trapped between the lower surface of the mat and the floor. Although there is sufficient traction on the relatively dry top surface, there is not enough traction on the wet bottom surface. In a busy work environment, the floor mat is gradually shifted away from its original position after hundreds or thousands of foot steps are applied to it throughout the course of a work day. It is troublesome and unpleasant to have to reposition a dirty and wet floor mat repeatedly every day.

People have tried to secure perforated rubber floor mats by tying each one to fixed structures or equipment nearby with a pair of cords. However, each cord is tied to the rim of a single hole on the floor mat. As foot steps are applied to the floor mat, a great deal of stress is concentrated on a narrow strip of rubber around the rim of each hole. The rubber strip is gradually severed by the cord after a period of use, and the cord must be tied to the rim of another hole. The rubber around the new hole is also severed after some use. The cords are periodically moved to other holes, so that more and more rubber around the holes are severed, until the floor mat is destroyed.

OBJECTS OF THE INVENTION

Accordingly, objects of the present perforated floor mat holder are:

to positively secure a perforated floor mat in position on a wet, slippery floor;

to secure the floor mat without damaging it;

to be easily installed on a floor;

to be easily broken into shorter sections to fit floor mats of different sizes;

to prevent being cut too short by a user.

Further objects of the present invention will become apparent from a consideration of the drawings and ensuing description.

BRIEF SUMMARY OF THE INVENTION

The present perforated floor mat holder is for securing perforated rubber floor mats on a wet and slippery floor. It is comprised of an elongated strip with studs arranged at regular intervals that match the spacing of the holes on the floor mat. The strip is fastened to a floor with screws inserted through mounting holes arranged along the strip. The floor mat is positioned on the strip with the hole around the studs. The stress applied to the rims of the holes by the studs are spread among a relatively large number of holes, so that the rims resist being torn by the studs. Transverse grooves arranged several studs apart on the strip enable the strip to be broken into shorter sections of a predetermined minimum length. In a first embodiment, one mounting hole is arranged between each pair of adjacent studs. In a second embodiment, two closely spaced mounting holes are arranged on either side of each groove. In a third embodiment, each mounting hole is arranged inside one of the studs.

DETAILED DESCRIPTION OF THE INVENTION

Figure 1:
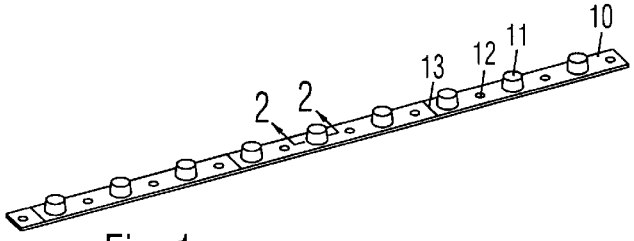
FIG. 1 is a top perspective view of a first embodiment of the present perforated floor mat holder.

FIG. 1:

A first embodiment of the present perforated floor mat holder is shown in a top perspective view in FIG. 1. It is comprised of an elongated strip 10 with studs 11 projecting from a top surface at regular intervals that generally match the spacing of the holes on a conventional perforated floor mat. Strip 10 is preferably made of a plastic material, such as "DELRIN" by Dupont. A plurality of mounting holes 12 are arranged on strip 10, preferably with each one between each pair of adjacent studs 11. Transverse grooves 13 are arranged across strip 10 every few studs apart. Strip 10 may be of a suitable length for securing the largest anticipated floor mat. When used for a smaller floor mat, strip 10 can be easily snapped into shorter sections at grooves 13. The minimum possible length of a section is determined by the distance between adjacent grooves 13, and is preferably long enough to include at least several studs 11 to distribute stress among enough holes on the floor mat and prevent it from tearing.

Figure 2:
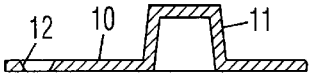
FIG. 2 is a side sectional view thereof, taken along line 2—2 in FIG. 1.

FIG. 2:

A sectional view of the floor mat holder of FIG. 1 is shown in FIG. 2. Stud 11 is integral with strip 10, for example, by being molded together. Stud 11 is preferably hollow on a lower side for reducing material without sacrificing strength, and tapered from a bottom end to a top end for easy molding. Strip 10 is preferably about 2.5 mm thick, and stud 11 is preferably about 15 mm tall. The spacing and diameter of studs 11 may be varied to fit different floor mats with different hole sizes and hole spacing.

Figure 3:
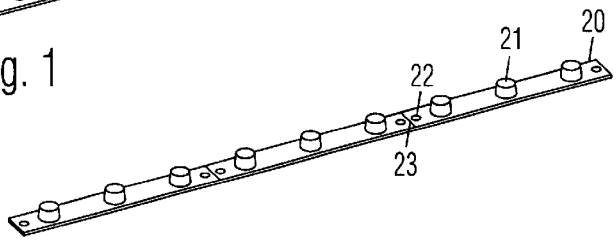
FIG. 3 is a top perspective view of a second embodiment thereof.

FIG. 3:

A second embodiment of the perforated floor mat holder is shown in a top perspective view in FIG. 3. It is comprised of an elongated strip 20 with studs 21 projecting from a top surface at regular intervals that generally match the spacing of the holes on a conventional perforated floor mat. Strip 20 is preferably made of a plastic material, such as "DELRIN" by Dupont. Two closely spaced mounting holes 22 are arranged on strip 20 every few studs apart. Transverse grooves 23 are arranged across strip 20 between every pair of holes 22. Strip 20 can be easily snapped into shorter sections at grooves 23. The minimum possible length of a section is determined by the distance between adjacent grooves 23, and is preferably long enough to include at least several studs 21 to distribute stress among enough holes on the floor mat and prevent it from tearing. Even when a shortest possible section is used, it will have a hole 22 at opposite ends for being properly secured to a floor.

Figure 4:
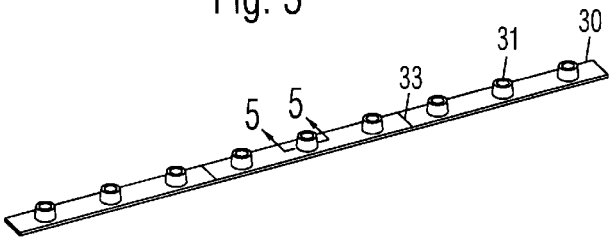
FIG. 4 is a top perspective view of a third embodiment thereof.

FIG. 4:

A third embodiment of the perforated floor mat holder is shown in a top perspective view in FIG. 4. It is comprised of an elongated strip 30 with studs 31 projecting from a top surface at regular intervals that generally match the spacing of the holes on a conventional perforated floor mat. Strip 30 is preferably made of a plastic material, such as "DELRIN" by Dupont. Transverse grooves 33 are arranged across strip 30 every few studs apart for enabling strip 30 to be easily snapped into shorter sections. The minimum possible length of a section is determined by the distance between adjacent grooves 33, and is preferably long enough to include at least several studs 31 to distribute stress among enough holes on the floor mat and prevent it from tearing.

Figure 5:
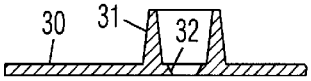
FIG. 5 is a side sectional view thereof, taken along line 5—5 in FIG. 4.

FIG. 5:

A sectional view of the third embodiment of the floor mat holder is shown in FIG. 5. Stud 31 is preferably integral with strip 30, for example, by being molded together. Stud 31 is preferably hollow on an upper side, with a tubular wall which is tapered on the inside and the outside for easy molding. Instead of having mounting holes outside the studs, strip 30 is provided with a mounting hole 32 at the bottom end of each hollow stud 31 for securing studs 31 more directly to the floor.

Figure 6:
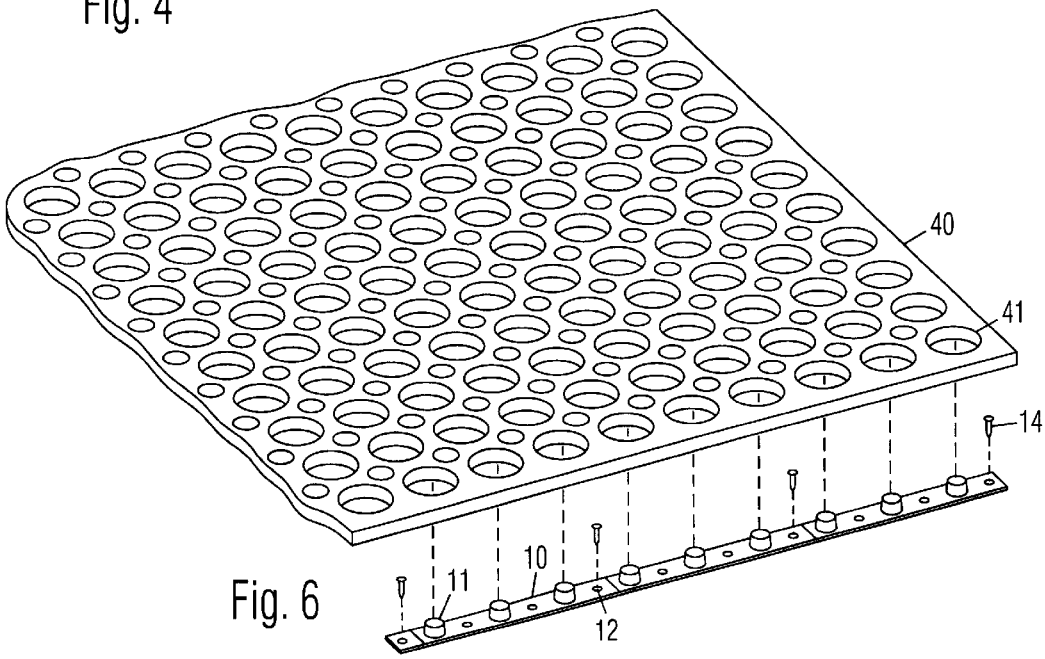
FIG. 6 is a top perspective assembly view of the perforated floor mat holder being installed under a perforated floor mat.

FIG. 6:

As an example, the first embodiment of the floor mat holder is shown in FIG. 6 being installed under a conventional floor mat 40. Floor mat 40 is placed in a desired position on the ground. Strip 10 is positioned under floor mat 40, with studs 11 projecting up through holes 41 in floor mat 40. Strip 10 may be broken into a shorter section prior to installation if necessary. Strip 10 is left in the selected position after floor mat 40 is temporarily removed. The positions of all mounting holes 12 on strip 10 are marked on the floor with a pencil, and holes are drilled into the ground at the marks. A hole is preferably drilled into every mark, but at least two holes must be drilled to prevent strip 10 from rotating. Strip 10 is positively secured to the floor with fasteners 14, such as screws or nails, inserted through each mounting hole 12. Floor mat 40 is placed on top of the floor mat holder, with studs 11 projecting up through holes 41. Although one floor mat holder can hold a floor mat in position, additional floor mat holders can be mounted under the floor mat if desired.

SUMMARY AND SCOPE

Accordingly, the present perforated floor mat holder positively secures a perforated floor mat in position on a wet, slippery floor. The floor mat can never shift position. It distributes stress among the rims of many holes on the floor mat, so that it does not damage the floor mat. It is easily installed on a floor. It is easily broken into shorter sections for fitting floor mats of different sizes. It guides a user into breaking it into sections of a minimum length with at least several studs for distributing stress on the floor mat.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A floor mat holder for securing a floor mat to a floor wherein said floor mat has an array of holes with perimeter wails, said floor mat holder comprising a base strip for placement beneath the floor mat between the floor mat and a floor, and a plurality of upright studs distributed over said base strip, said upright studs being spaced apart in correspondence with the spacing of the holes in the array of holes in the floor mat, said base strip being securable to a floor, such that, when secured to a floor, the floor mat can be placed over the floor mat holder with the plurality upright studs on said base strip engaged in a corresponding plurality of holes within the array of holes in the floor mat for holding the floor mat in position on the floor, said upright studs being sized and shaped to contact the perimeter walls of the holes in the floor mat at points distributed substantially evenly around such perimeter walls when said studs are engaged in the holes of the floor mat.

2. The floor mat holder of claim 1 wherein said upright studs are generally cylindrical in shape.

3. The floor mat holder of claim 2 wherein said generally cylindrically shaped studs have cylindrical walls that taper inwardly toward the top of the stud.

4. The floor mat holder of claim 1 wherein said base strip has a plurality of mounting holes for receiving fasteners for securing the floor mat holder to the floor.

5. The floor mat holder of claim 1 wherein an opening extends through at least selected ones of said studs for receiving fasteners for securing the floor mat holder to the floor.

6. The floor mat holder of claim 1 wherein at least selected ones of said studs are cup shaped with an open top and a bottom, and wherein a mounting hole is provided in the bottom of said cup shaped studs for receiving fasteners for securing the floor mat holder to the floor.

7. The floor mat holder of claim 1 wherein said base strip is an elongated strip having transverse grooves between selected studs for facilitating the breaking of said base strip into base strips of shorter lengths.

8. A floor mat holder for securing a floor mat to a floor wherein said floor mat has an array of holes with perimeter walls, said floor mat holder comprising an elongated base strip for placement beneath the floor mat between the floor mat and a floor, said elongated base strip having a plurality of mounting holes for receiving fasteners for securing the floor mat holder to the floor, and a plurality of upright studs distributed over said base strip, said upright studs being spaced apart in correspondence with the spacing of the holes in the array of holes in the floor mat and having cylindrical walls that taper inwardly toward the top of the stud, said base strip having transverse grooves between selected studs for facilitating the breaking of said base strip into base strips of shorter lengths, and said base strip being securable to a floor, such that, when secured to a floor, the floor mat can be placed over the floor mat holder with the plurality upright studs on said base strip engaged in a corresponding plurality of holes within the array of holes in the floor mat for holding the floor mat in position on the floor, said upright studs being sized and shaped to contact the perimeter walls of the holes in the floor mat at points around such perimeter walls when said studs are engaged in the holes of the floor mat.

9. The floor mat holder of claim 8 wherein said mounting holes include openings that extend through at least selected ones of said studs.

10. The floor mat holder of claim 9 wherein at least selected ones of said studs are cup shaped with an open top and a bottom, and wherein a mounting hole is provided in the bottom of said cup shaped studs.

11. A floor mat system comprising a floor mat having an array of holes with perimeter walls, a floor mat holder comprised of a base strip for placement beneath the floor mat between the floor mat and a floor, and a plurality of upright studs distributed over said base strip, said upright studs being spaced apart in correspondence with the spacing of the holes in the array of holes in the floor mat, said base strip being securable to a floor, such that, when secured to a floor, the floor mat can be placed over the floor mat holder with the plurality upright studs on said base strip engaged in a corresponding plurality of holes within the array of holes in the floor mat for holding the floor mat in position on the floor, said upright studs being sized and shaped to contact the perimeter walls of the holes in the floor mat at points distributed substantially evenly around such perimeter walls when said studs are engaged in the holes of the floor mat.

12. The floor mat system of claim 11 wherein said upright studs are generally cylindrical in shape.

13. The floor mat system of claim 12 wherein the holes in said floor mat are circular.

14. The floor mat system of claim 12 wherein said generally cylindrically shaped studs have cylindrical walls that taper inwardly toward the top of the stud.

15. The floor mat system of claim 11 wherein said base strip has a plurality of mounting holes for receiving fasteners for securing the floor mat holder to the floor.

16. The floor mat system of claim 11 wherein an opening extends through at least selected ones of said studs for receiving fasteners for securing the floor mat holder to the floor.

17. The floor mat system of claim 11 wherein at least selected ones of said studs are cup shaped with an open top and a bottom, and wherein a mounting hole is provided in the bottom of said cup shaped studs for receiving fasteners for securing the floor mat holder to the floor.

18. The floor mat system of claim 11 wherein said base strip is an elongated strip having transverse grooves between selected studs for facilitating the breaking of said base strip into base strips of shorter lengths.

* * * * *